US011713227B2

(12) United States Patent
Wu et al.

(10) Patent No.: US 11,713,227 B2
(45) Date of Patent: Aug. 1, 2023

(54) PRESSING DEVICE

(71) Applicants: Chun-Hsien Wu, Taichung (TW); Gang Chen, Ningbo (CN)

(72) Inventors: Chun-Hsien Wu, Taichung (TW); Gang Chen, Ningbo (CN)

( * ) Notice: Subject to any disclaimer, the term of this patent is extended or adjusted under 35 U.S.C. 154(b) by 872 days.

(21) Appl. No.: 16/740,650

(22) Filed: Jan. 13, 2020

(65) Prior Publication Data

US 2020/0317479 A1 Oct. 8, 2020

(30) Foreign Application Priority Data

Apr. 3, 2019 (TW) ..... 108111813

(51) Int. Cl.
*B66F 3/36* (2006.01)
*B66F 3/10* (2006.01)

(52) U.S. Cl.
CPC . *B66F 3/36* (2013.01); *B66F 3/10* (2013.01)

(58) Field of Classification Search
CPC ..... B66F 3/36; B66F 3/10; B66F 3/38; B66F 3/24; B66F 3/42; B25B 27/026; B25B 27/0021
See application file for complete search history.

(56) References Cited

U.S. PATENT DOCUMENTS 2,550,163 A * 4/1951 Phenning ..... B66F 3/42 74/543
3,890,684 A * 6/1975 Tallman ..... B23P 15/00 254/93 H
4,000,758 A * 1/1977 Meisenheimer, Jr. .. B64C 27/51 92/62
5,251,445 A * 10/1993 Farell ..... B66F 3/42 60/474
5,542,646 A * 8/1996 Bunyan ..... A62B 3/005 60/478
5,678,293 A * 10/1997 Sturdevant ..... B25B 27/16 29/254
5,860,203 A * 1/1999 Gehr, Jr. ..... B25B 27/026 29/257
6,073,886 A * 6/2000 Jakubowski, Jr. .. F15B 15/1466 92/151

(Continued)

FOREIGN PATENT DOCUMENTS

TW 201808553 A * 3/2018

*Primary Examiner* — Seahee Hong
(74) *Attorney, Agent, or Firm* — Muncy, Geissler, Olds & Lowe, P.C.

(57) ABSTRACT

A pressing device is provided, including: a main body, including a chamber; a pushing assembly, including a retractable mechanism movably inserted within the chamber, a first pushing board connected with the retractable mechanism and a restricting member embedded within the chamber and blocking the retractable mechanism from moving out of the chamber; a hydraulic mechanism, including a tube body which is connected with the main body and communicated with the chamber, a driving rod movably inserted within the tube body and a piston driven by the driving rod, the piston being configured to drive fluid to flow in or out of the chamber. Another pressing device is further provided, differing from the pressing device described above in that: the main body further including a channel, a wall of the chamber including at least one recession which is communicated with the channel.

10 Claims, 7 Drawing Sheets

(56) References Cited

U.S. PATENT DOCUMENTS

| | | | | |
|---|---|---|---|---|
| 6,574,846 | B1 * | 6/2003 | Kang | B25B 27/0035 29/256 |
| 8,826,504 | B1 * | 9/2014 | Slivon | B25B 27/0035 29/244 |
| 9,657,792 | B2 * | 5/2017 | Chen | B25B 27/023 |
| 11,391,334 | B2 * | 7/2022 | Dahl | B25B 27/0021 |

* cited by examiner

PRESSING DEVICE

BACKGROUND OF THE INVENTION

Field of the Invention

The present invention relates to a pressing device.

Description of the Prior Art

Generally, to force two spaced objects away from each other, a crowbar can be disposed between the two objects so as to lever the two objects to move away from each other. However, the crowbar can damage the two objects, and the distance between the two objects cannot be accurately controlled, which is not easy to use. Therefore, a mechanical or hydraulic pressing device has been developed.

The conventional pressing device includes a base, a driving screw screwed on the base and two pushing boards disposed opposite. One of the two pushing boards is disposed on the base, and the other of the two pushing boards is drivable by the screw to displace. However, the conventional mechanical pushing or hydraulic pressing device has a complicated structure, is inconvenient to process and assemble, and has a limited distance that can be pushed, thus resulting in narrow application.

The present invention is, therefore, arisen to obviate or at least mitigate the above-mentioned disadvantages.

SUMMARY OF THE INVENTION

The main object of the present invention is to provide a pressing device which has a simple structure and is easy to manufacture and assemble.

To achieve the above and other objects, the present invention provides a pressing device, including: a main body, including a chamber; a pushing assembly, including a retractable mechanism movably inserted within the chamber, a first pushing board connected with the retractable mechanism and a restricting member, the restricting member being embedded within an inner surface of the chamber, the restricting member blocking the retractable mechanism from moving out of the chamber in a moving path of the retractable mechanism; a hydraulic mechanism, including a tube body which is connected with the main body and communicated with the chamber, a driving rod movably inserted within the tube body and a piston driven by the driving rod, the piston being configured to drive fluid to flow in or out of the chamber.

To achieve the above and another objects, the present invention provides a pressing device, including: a main body, including a chamber and a channel, a wall of the chamber including at least one recession which is communicated with the channel; a pushing assembly, including a retractable mechanism movably inserted within the chamber and a first pushing board connected with the retractable mechanism; a hydraulic mechanism, including a tube body which is connected with the main body and communicated with the channel, a driving rod movably inserted within the tube body and a piston driven by the driving rod, the piston being configured to drive fluid to flow, via the channel, into or out of the chamber.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
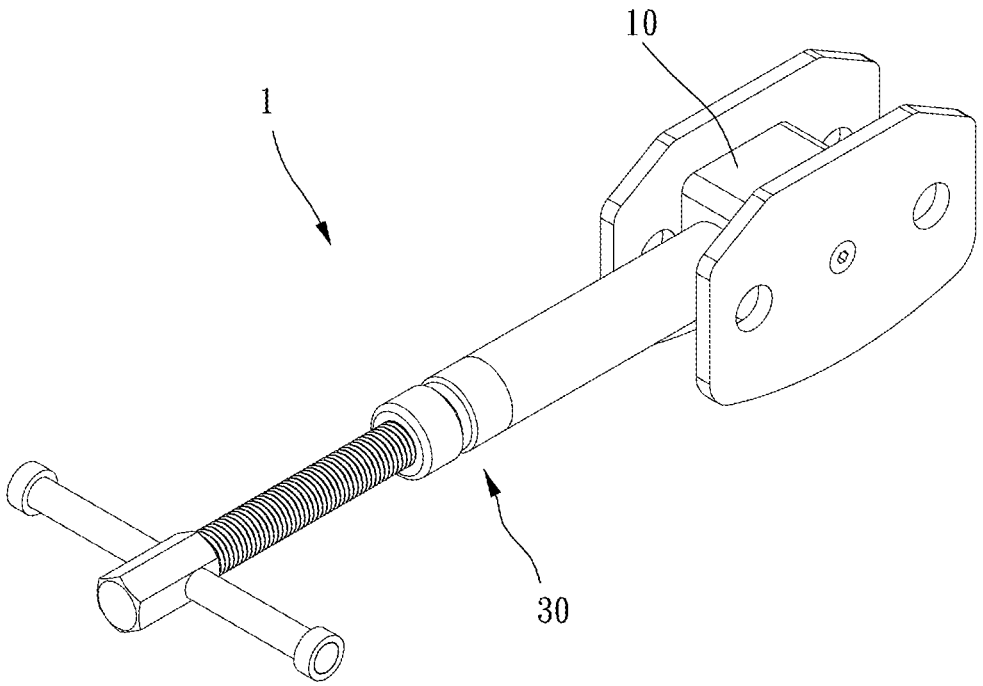
FIG. 1 is a stereogram of a preferable embodiment of the present invention.
Figures 2, 3, 4:
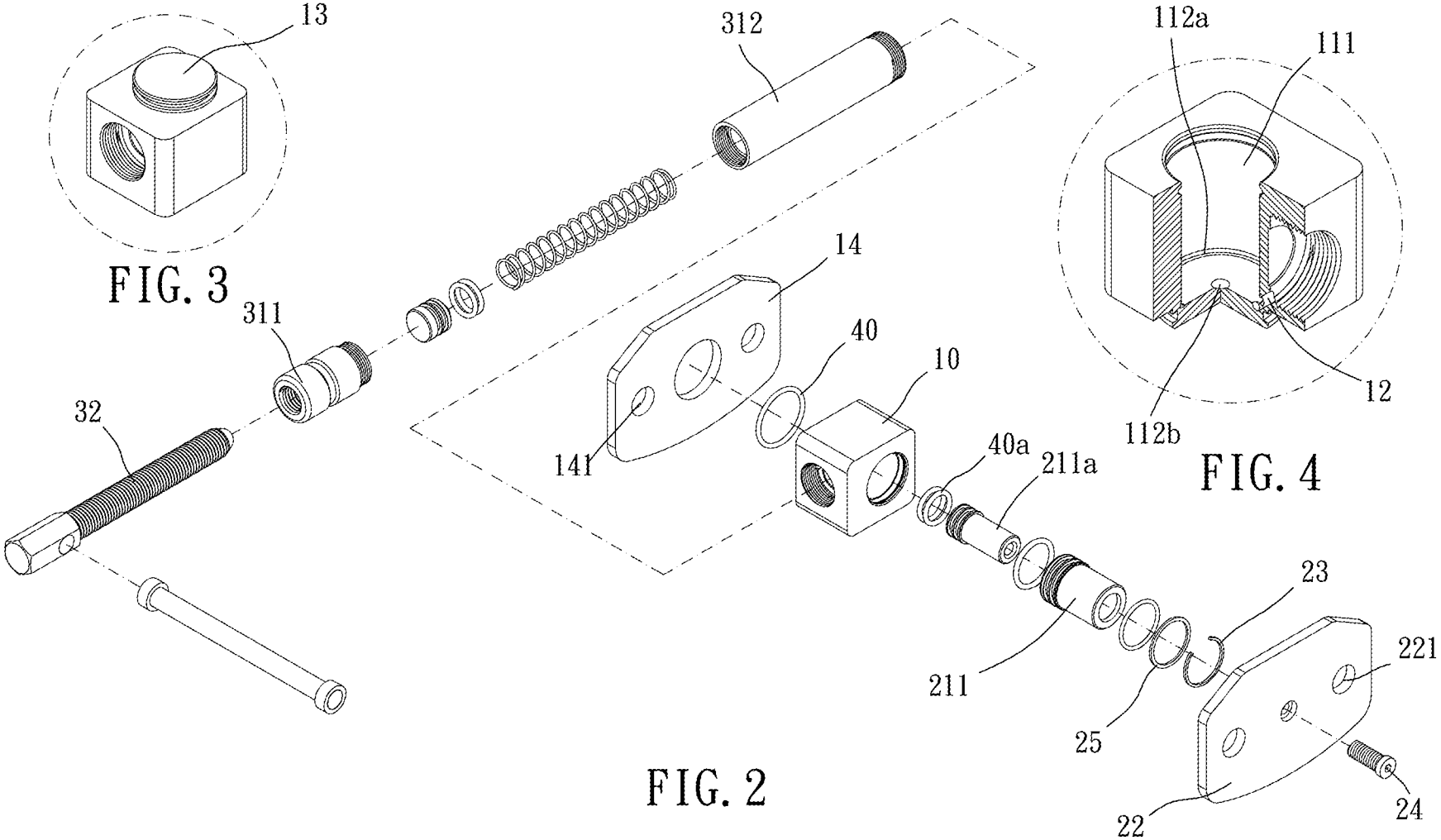
FIG. 2 is a breakdown drawing of a preferable embodiment of the present invention.
FIG. 3 is a stereogram showing a main body of a preferable embodiment of the present invention.
FIG. 4 is a partial perspective cross-sectional view of the main body of a preferable embodiment of the present invention.
Figure 5:
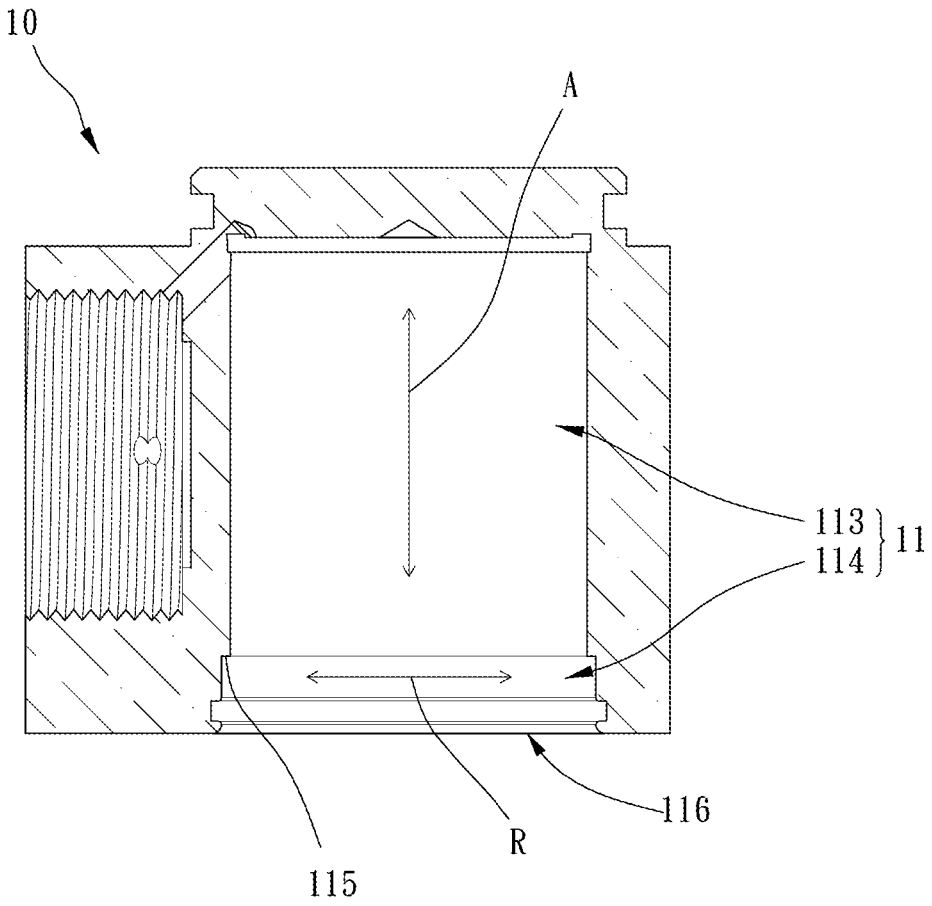
FIG. 5 is a cross-sectional view of the main body of a preferable embodiment of the present invention.

Please refer to FIGS. 1 to 10 for a preferable embodiment of the present invention. A pressing device 1 of the present invention includes a main body 10, a pushing assembly 20 and a hydraulic mechanism 30.

The main body 10 includes a chamber 11 and a channel 12, a wall 111 of the chamber 11 includes at least one recession 112 which is communicated with the channel 12; the pushing assembly 20 includes a retractable mechanism 21 movably inserted within the chamber 11 and a first pushing board 22 connected with the retractable mechanism 21; the hydraulic mechanism 30 includes a tube body 31 which is connected with the main body 10 and communicated with the channel 12, a driving rod 32 movably inserted within the tube body 31 and a piston 33 driven by the driving rod 32, the piston 33 is configured to drive fluid to flow, via the channel 12, into or out of the chamber 11. Whereby, the pressing device 1 has a simple structure and is easy to manufacture and assemble, and the at least one recession 112 is configured to allow the fluid to enter the chamber 11 to push the retractable mechanism 21.

Preferably, the tube body 31 is disposed lateral to the chamber 11, and the retractable mechanism 21 is movable to be within the chamber 11 and at least partially overlapable with the channel 12 in a radial direction R of the chamber 11, so that the retractable mechanism 21 can travel for a relative larger distance relative to the chamber 11. The retractable mechanism 21 is movable to at least partially cover an end opening 121 of the channel 12. In this embodiment, the retractable mechanism 21 partially covers the end opening 121, which facilitating entering of the fluid. In other embodiments, the retractable mechanism may completely cover the end opening, in which the fluid can flow into the chamber via the recession; the retractable mechanism may not cover the end opening; the wall of the chamber may be provided without any recession, and near the end opening the retractable mechanism may include a chamfer at its end face so as to define a gap with the wall of the chamber, and the fluid can enter the chamber via the gap to push the retractable mechanism to move outwardly.

Specifically, the main body 10 further includes a connection portion 13 extending toward a direction away from the first pushing board 22, the connection portion 13 is connected with a second pushing board 14 opposite to the first pushing board 22, and the recession 112 is at least partially recessed within the connection portion 13. In this embodiment, the second pushing board 14 is engaged with the connection portion 13 through a seal ring 40, and the recession 112 includes an annular groove 112*a* between a circumferential wall and a bottom wall of the chamber 11 and a concave 112*b* on the bottom wall, and thus the fluid can flow into the annular groove 112*a* and the concave 112*b* and is configured to stably push the retractable mechanism 21 outwardly; the chamber 11 is partially recessed within the connection portion 13, and the chamber 11 has a fixed radial dimension so that it has a simple and compact structure and easy to manufacture and so that the retractable mechanism 21 can travel for a relative larger distance. The recession may be disposed on the circumferential wall of the chamber; the recession may be formed in other configuration; the second pushing board and the main body may be integrally formed of one piece; and the chamber may has different radial hole dimensions. The first pushing board 22 and the second pushing board 14 each have at least one through hole 141, 221 configured for assembling of a plate, which increases working area.

Figure 6:
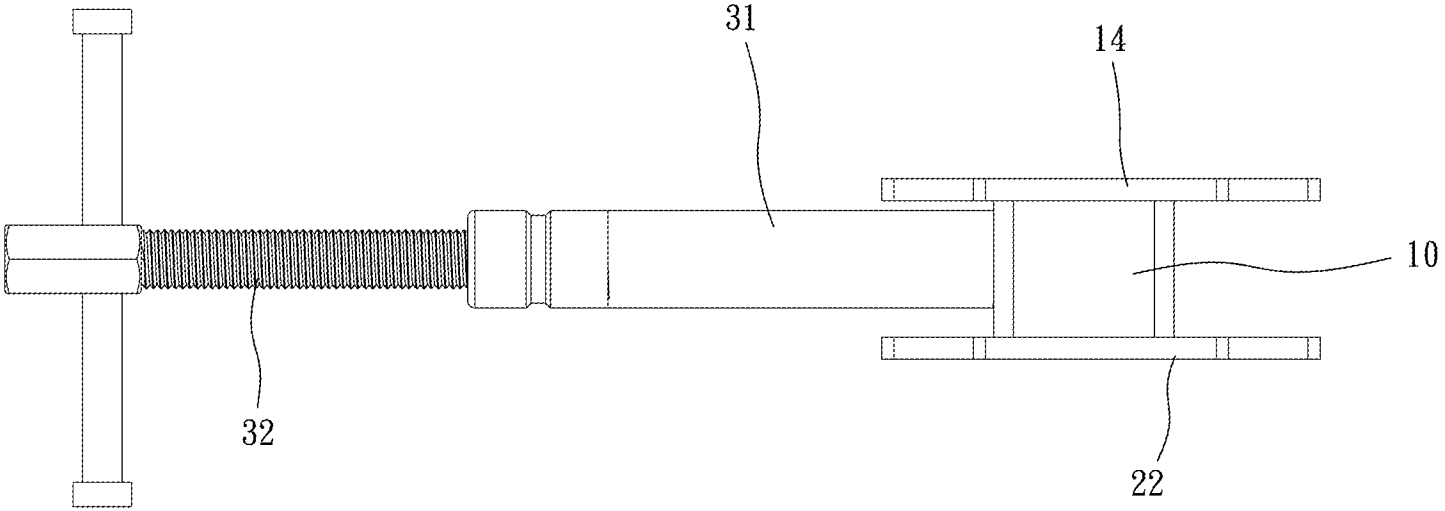
FIG. 6 is a side view of a preferable embodiment of the present invention.
Figure 7:
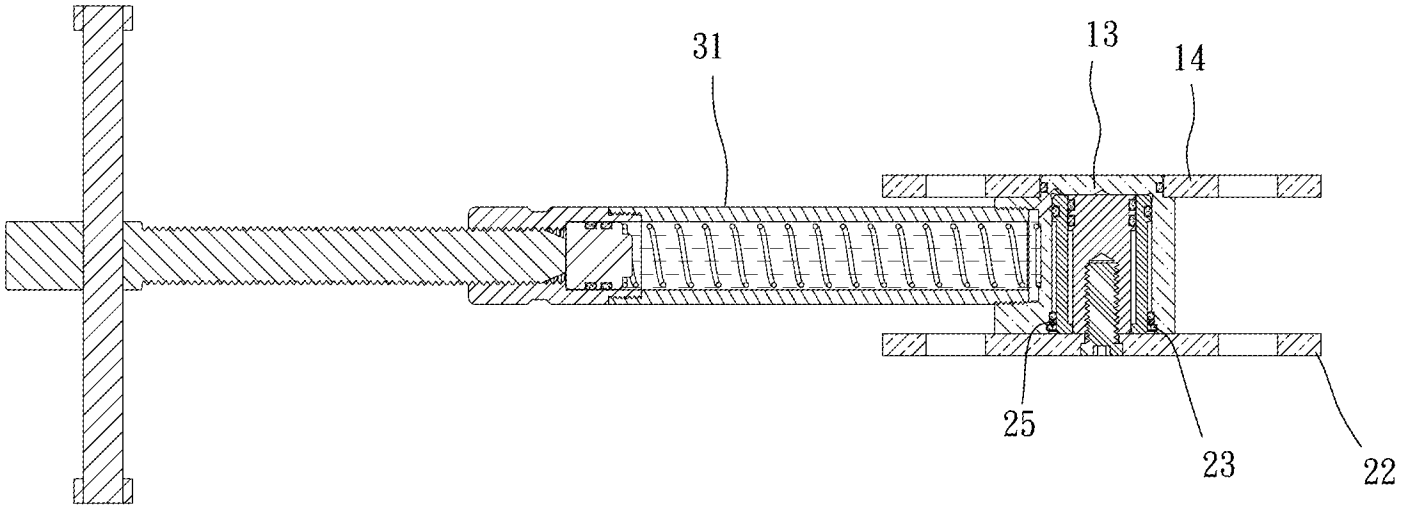
FIGS. 7, 8 and 10 are drawings showing operation of a preferable embodiment of the present invention.
Figure 9:
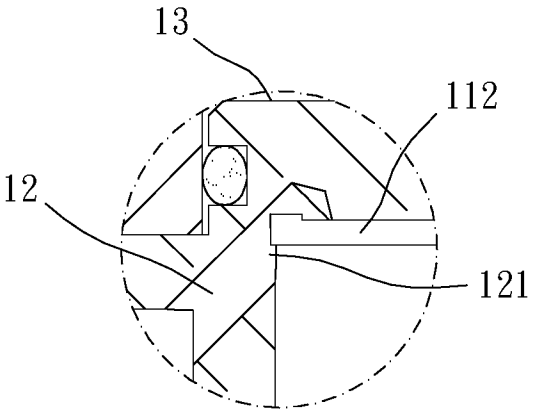
FIG. 9 is an enlargement of FIG. 8.

The pushing assembly 20 further includes a restricting member 23 engaged within an inner surface of the chamber 11, the restricting member 23 is configured to block the retractable mechanism 21 from moving out of the chamber 11 in a moving path of the retractable mechanism 21. In this embodiment, the restricting member 23 is C-shaped, thus being easy to assemble and stable to engage with the retractable mechanism 21. As a result, the main body 10 can be provided without any additional restricting structure for restricting the retractable mechanism 21, and thus it has a simple structure and the retractable mechanism 21 can move entirely into the chamber 11 so that the first pushing board 22 can be abutted directly against the main body 10 (as shown in FIG. 6) and so that the first pushing board 22 and the second pushing board 14 are closer and suitable for narrow working spaces. In other embodiments, the restricting member may be screwed to the inner surface or other portion of the main body.

Specifically, the pushing assembly 20 further includes a stabilizing member 25 received in the chamber, the stabilizing member 25 is abutted between an outer circumferential surface of the retractable mechanism 21 and the inner surface of the chamber 11, and thus the retractable mechanism 21 can be supported in the radial direction R of the chamber 11 so that the retractable mechanism 21 is stably movable along an axial direction A of the chamber 11 and so that the piston can be stably pushed back by the first pushing board 22. The stabilizing member 25 is preferably made of metal, which has strong structure. The stabilizing member 25 normally restricts the retractable mechanism 21 in the radial direction R so that the retractable mechanism 21 is stable under any conditions. In this embodiment, the stabilizing member 25 is a ring detachably sleeved around the retractable mechanism 21, and thus the stabilizing member 25 can be assembled into the chamber 11 together with the retractable mechanism 21 quickly.

In the axial direction A, the chamber 11 includes a small diameter section 113 and a large diameter section 114 which are communicated with each other, a stepped portion 115 is disposed at an intersection of the small diameter section 113 and the large diameter section 114, the large diameter section 114 is open at a side of the main body 10 to define an opening 116, the retractable mechanism 21 is pillar-shaped and disposed through the opening and inserted into the chamber 11, the retractable mechanism 21 is projectable out of the opening 116, and the stabilizing member 25 is received in the large diameter section 114 and blockable by the stepped portion 115 in the axial direction A. When the retractable mechanism 21 protrudes out of the opening 116, the stabilizing member 25 provides sufficient support for the retractable mechanism 21.

Preferably, the retractable mechanism 21 includes at least two sleeve members 211, 211*a*, one of the at least two sleeve members 211 is fluid-tightly connected with the chamber 11, and each of the at least two sleeve members 211, 211*a* are relatively movable and fluid-tightly sleeved with each other co-axially, which increases range of movement of the first pushing board 22 away from the second pushing board 14. Preferably, at least one seal ring 40*a* is disposed between the sleeve member 211, 211*a*, thus improving sealing effect. the pushing assembly 20 further includes a fastener 24 detachably connected with the first pushing board 22 and connected to the retractable mechanism 21, which is easy to assembly/disassembly, repair and replace.

The hydraulic mechanism 30 further includes an elastic member 34 disposed in the tube body 31 and between the piston 33 and the main body 10. When the driving rod 32 rotates and moves outwardly relative to the tube body 31, the piston 33 is pushed by the elastic member 34 so that the liquid flows from the chamber 11 into the tube body 31 and the retractable mechanism 21 retracts into the chamber 11.

The hydraulic mechanism may be provided without the elastic member, the piston may be connected and co-movable with the driving rod. Preferably, the tube body 31 includes a head portion 311 connected with the driving rod 32 and a body portion 312 detachably connected with and between the head portion 311 and the main body 10. In this embodiment, each said driving rod 32, and the head portion 311, the body portion 312 and the main body 10 is screwed with one another, thus being convenient to assembly/disassembly, repair and replace.

Figure 8:
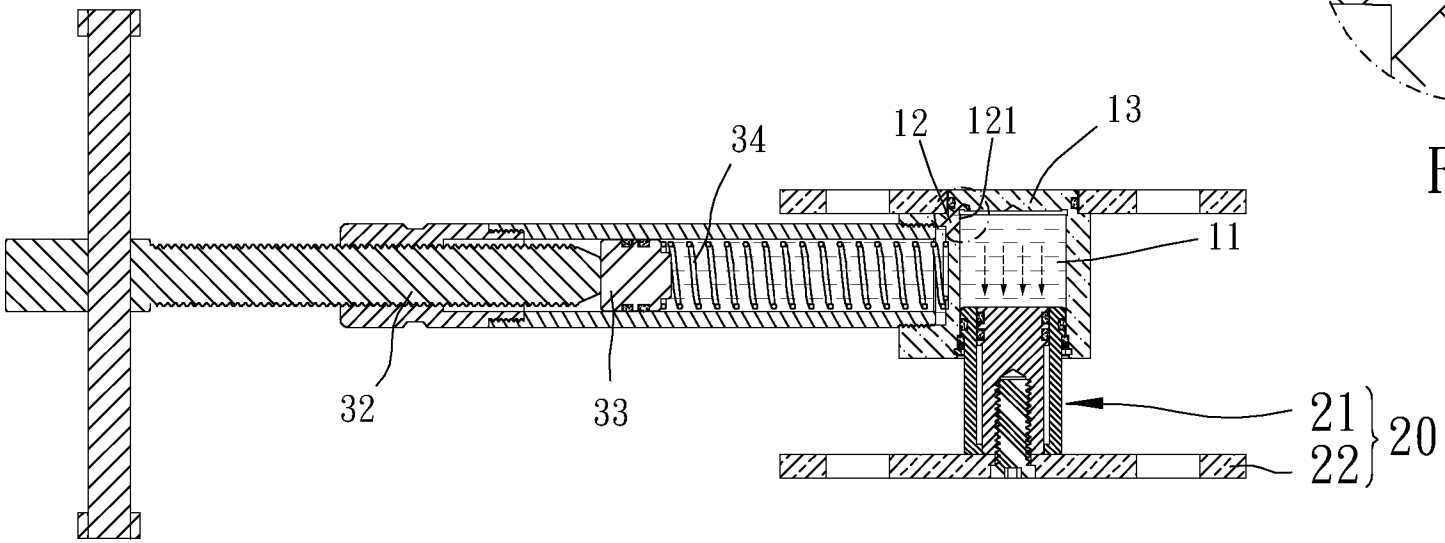
Figure 10:
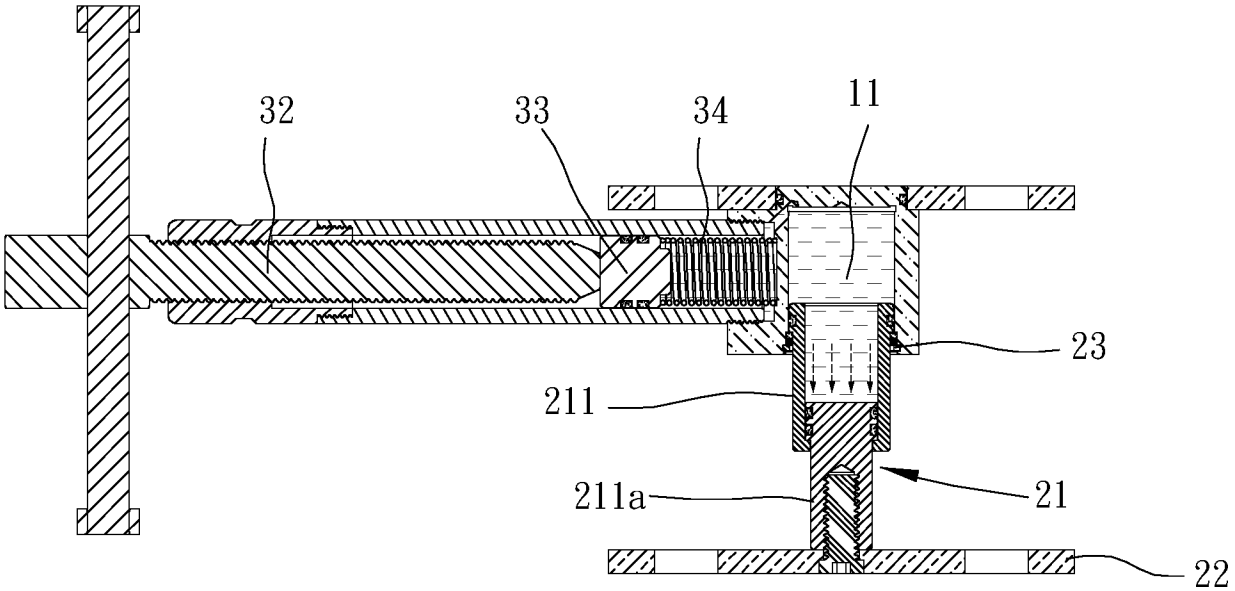

As shown in FIGS. 7-10, during operation, the driving rod 32 rotates and moves into the tube body 31 to push the piston 33, and the piston 33 pushes the fluid to flow from the tube body 31, via the channel 12, into the chamber 11, so as to push the at least two sleeve members 211, 211*a* to move outwardly. Due to the difference between cross-sectional areas of the sleeve members 211, 211*a* on which the fluid pushes, the sleeve member 211 which has a larger radial dimension is firstly pushed out (as shown in FIG. 8), and the sleeve member 211*a* which has a smaller radial dimension is then pushed out (as shown in FIG. 10), which can increasing distance between the first and second pushing boards 22. In other embodiments, the order of moving of the sleeve members may be different according to different configurations or application requirements.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A pressing device, including:

a main body, including a chamber;

a pushing assembly, including a retractable mechanism movably inserted within the chamber, a first pushing board connected with the retractable mechanism and a restricting member, the restricting member being embedded within an inner surface of the chamber, the restricting member blocking the retractable mechanism from moving out of the chamber in a moving path of the retractable mechanism;

a hydraulic mechanism, including a tube body which is connected with the main body and communicated with the chamber, a driving rod movably inserted within the tube body and a piston driven by the driving rod, the piston being configured to drive fluid to flow in or out of the chamber;

wherein the pushing assembly further includes a stabilizing member received in the chamber, and the stabilizing member is abutted between an outer circumferential surface of the retractable mechanism and the inner surface of the chamber.

2. The pressing device of claim 1, wherein the hydraulic mechanism further includes an elastic member disposed in the tube body and between the piston and the main body.

3. The pressing device of claim 1, wherein the retractable mechanism includes at least two sleeve members, one of the at least two sleeve members is fluid-tightly connected with the chamber, and each of the at least two sleeve members are relatively movable and fluid-tightly sleeved with each other co-axially.

4. The pressing device of claim 1, wherein the pushing assembly further includes a fastener detachably connected with the first pushing board and connected to the retractable mechanism.

5. The pressing device of claim 1, wherein in an axial direction of the chamber, the chamber includes a small diameter section and a large diameter section which are communicated with each other, a stepped portion is disposed at an intersection of the small diameter section and the large diameter section, the large diameter section is open at a side of the main body to define an opening, the retractable mechanism is pillar-shaped and disposed through the opening and inserted into the chamber, the retractable mechanism is projectable out of the opening, and the stabilizing member is received in the large diameter section and blockable by the stepped portion in the axial direction.

6. A pressing device, including:

a main body, including a chamber and a channel, a wall of the chamber including at least one recession which is communicated with the channel;

a pushing assembly, including a retractable mechanism movably inserted within the chamber and a first pushing board connected with the retractable mechanism;

a hydraulic mechanism, including a tube body which is connected with the main body and communicated with the channel, a driving rod movably inserted within the tube body and a piston driven by the driving rod, the piston being configured to drive fluid to flow, via the channel, into or out of the chamber;

wherein the tube body is disposed lateral to the chamber, the retractable mechanism is movable to be within the chamber and at least partially overlapable with the channel in a radial direction of the chamber.

7. The pressing device of claim 6, wherein the retractable mechanism is movable to at least partially cover an end opening of the channel.

8. The pressing device of claim 6, wherein the main body further includes a connection portion extending toward a direction away from the first pushing board, the connection portion is connected with a second pushing board opposite to the first pushing board, and the recession is at least partially recessed within the connection portion.

9. The pressing device of claim 8, wherein the chamber at least partially extends within the connection portion.

10. The pressing device of claim 7, wherein the main body further includes a connection portion extending toward a direction away from, the connection portion is connected with a second pushing board opposite to the first pushing board, and the recession is at least partially recessed within the connection portion; the chamber at least partially extends within the connection portion; the hydraulic mechanism further includes an elastic member disposed in the tube body and between the piston and the main body; the retractable mechanism includes at least two sleeve members, one of the at least two sleeve members is fluid-tightly connected with the chamber, and each of the at least two sleeve members are relatively movable and fluid-tightly sleeved with each other co-axially; the pushing assembly further includes a fastener detachably connected with the first pushing board and connected to the retractable mechanism; the pushing assembly further includes a restricting member engaged within an inner surface of the chamber, the restricting member blocking the retractable mechanism from moving out of the chamber in a moving path of the retractable mechanism; the tube body includes a head portion connected with the driving rod and a body portion detachably connected with and between the head portion and the main body; the first pushing board and the second pushing board each have at least one through hole configured for assembling of a plate; the pushing assembly further includes a stabilizing member received in the chamber, the stabilizing member is abutted between an outer circumferential surface of the retractable mechanism and the inner surface of the chamber; in an axial direction of the chamber, the chamber includes a small diameter section and a large diameter section which are communicated with each other, a stepped portion is disposed at an intersection of the small diameter section and the large diameter section, the large diameter section is open at a side of the main body to define an opening, the retractable mechanism is pillar-shaped and disposed through the opening and inserted into the chamber, the retractable mechanism is projectable out of the opening, and the stabilizing member is received in the large diameter section and blockable by the stepped portion in the axial direction; the stabilizing member is a ring detachably sleeved around the retractable mechanism; the stabilizing member is made of metal.

* * * * *